US005199932A

United States Patent [19]

Liao

[11] Patent Number: 5,199,932

[45] Date of Patent: Apr. 6, 1993

[54] GYMNASTIC APPARATUS PROVIDING ANIMATION OF CLIFF CLIMBING

[76] Inventor: Nien-Yuan Liao, No. 264, Sec. 2, Shi-Tung Rd., Taichung, Taiwan

[21] Appl. No.: 955,137

[22] Filed: Oct. 1, 1992

[51] Int. Cl.[5] ..... A63B 22/04

[52] U.S. Cl. ..... 482/53; 482/113; 482/37

[58] Field of Search ..... 482/52, 37, 53, 111, 482/112, 113, 51; 128/25 R

[56] References Cited

U.S. PATENT DOCUMENTS 2,079,594 5/1937 Clem ..... 128/25 R
4,958,830 9/1990 Huggins et al. ..... 482/52
5,007,631 4/1991 Wang ..... 482/52

*Primary Examiner*—Stephen R. Crow

*Attorney, Agent, or Firm*—Browdy and Neimark

[57] ABSTRACT

A gymnastic apparatus has a frame made up of a hollow main brace and a support brace, a base brace upon which the main brace and the support brace are mounted, two hollow sliding rods parallel to each other and having top portions of a length extending out of the main brace, two oil pressure cylinders arranged in a parallel manner at the bottom of the main brace and provided with piston rods having top ends coupled with the bottoms of the sliding rods, a connecting tube in communication with the two oil pressure cylinders, an adjustment button for controlling the flow of fluid between the two oil pressure cylinders, two pedals fastened respectively to the bottoms of the sliding rods by means of shaft pins, and two hand grips fastened respectively to the sliding rods. The gymnastic apparatus provides an animated exercise of cliff climbing.

2 Claims, 3 Drawing Sheets

GYMNASTIC APPARATUS PROVIDING ANIMATION OF CLIFF CLIMBING

BACKGROUND OF THE INVENTION

The present invention relates to a gymnastic device, and more particularly to a gymnastic apparatus having means to provide an animation of cliff claimbing.

There are a variety of gymnastic apparatus, some of which are provided ingeniously with mechanical means capable of reproducing a lively quality of an outdoor exercise, such as cliff claimbing. Such gymnastic apparatus permits its user to imitate the motion of cliff climbing by stepping up and down in conjunction with the upward and the downward movements of his or her hands.

There are many such cliff-climbing gymnastic apparatus that are currently available in the market. Such prior art gymnastic apparatus are generally defective in design in that they are cumbersomely made up of many component parts which are often difficult and troublesome to put them together and which are expensive to make. In addition, such prior art gymnastic apparatus are provided with a damping-adjusting device, which is mounted at a lower portion of the frame and is therefore beyond the reach of a user at such time when the user is in the midst of doing the exercise. As a result, the user is required to stop doing the exercise so as to be able to adjust the damping of the gymnastic apparatus that he or she is using.

SUMMARY OF THE INVENTION

It is therefore the primary objective of the present invention to provide a gymnastic apparatus, which is used by an exerciser to imitate the motion of cliff climbing and which is so structurally simple that it can be made quickly and economically.

It is another objective of the present invention to provide a gymnastic apparatus, which is used by an exerciser to imitate the motion of cliff climbing and which is furnished with a damping-adjusting device capable of being reached by a user at such time when the user is in the midst of doing exercise.

In keeping with the principles of the present invention, the foregoing objectives of the present invention are accomplished by a gymnastic apparatus, which comprises a frame, two hollow sliding rods, two oil pressure cylinders, a connecting tube, an adjustment botton, two pedals, and two hand grips. The frame comprises a bottom brace, a hollow main brace and a hollow support brace which jointly form a supporting structure of an inverted Y-shaped construction. The main brace is provided at the bottom of both sides thereof with an elongate slot of a predetermined length. The two hollow sliding rods are arranged inside the main brace in a manner that they are parallel to each other and that they are able to slide along the axial direction of the main brace. The upper ends of both sliding rods extend beyond the top of the main brace. The two oil pressure cylinders are mounted on the main brace in such a manner that they are parallel to each other at the bottom of the main brace, with the piston rods of the two cylinders mounted at the tops thereof to the inner wall of the bottom of the sliding rod in a manner that they move synchronously. The connecting tube has two ends which are disposed at the bottom of the two oil pressure cylinders, so that the flow of gas takes place in the cylinders. The adjustment button is disposed at the mid-section of the connecting tube, so as to control the flow quantity of the gas in the tube. The adjustment button is mounted at the mid-section of the front surface of the main brace in order to allow the user of the gymnastic apparatus to reach for it easily. The two pedals are respectively disposed in the elongate slots of the main brace and fastened respectively to the bottom ends of the sliding rods by means of shaft pins so as to activate the piston rods. The two hand grips are respectively fastened to the top ends of the two sliding rods. When a user of the gymnastic apparatus steps on the two pedals, the two sliding rods are driven so that both hands of the user holding the hand grips move up and down along with the two pedals.

The foregoing objectives, features and functions of the present invention will be better understood by studying the following detailed description of a preferred embodiment of the present invention, in conjunction with the drawings provided herewith.

DETAILED DESCRIPTION OF THE PREFERRED EMBODIMENT

Figure 1:
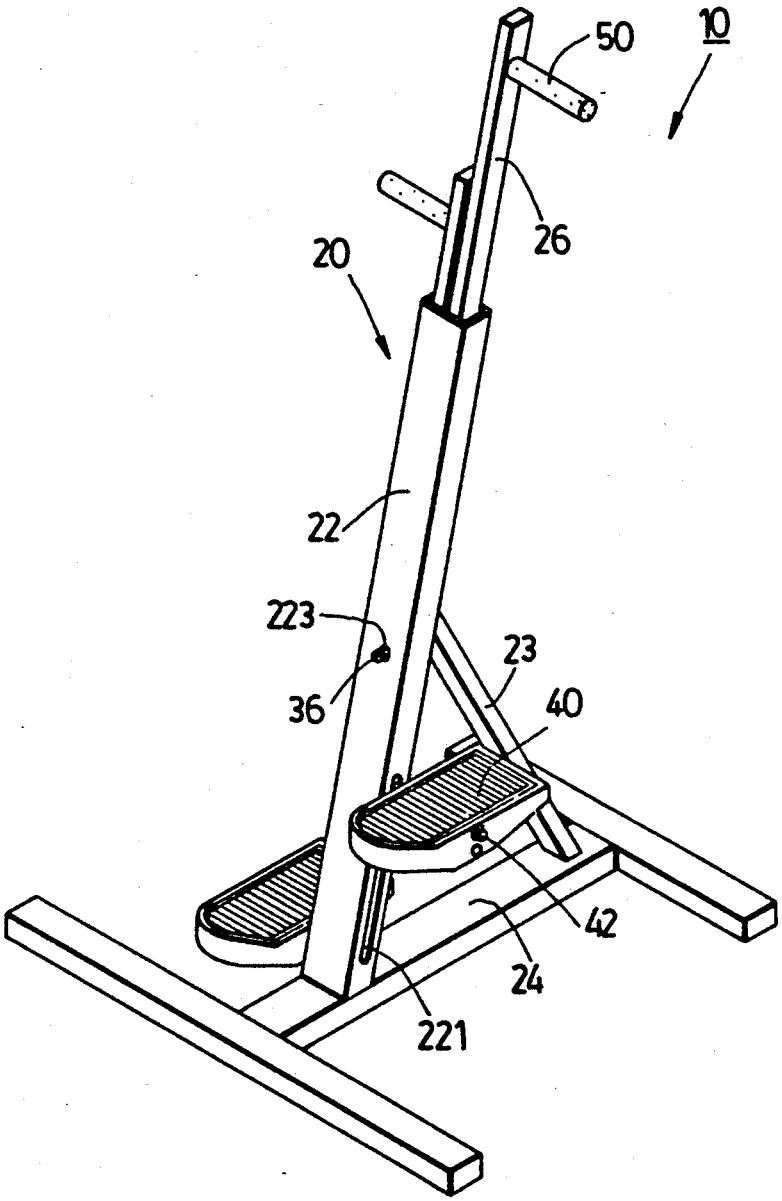
FIG. 1 shows a perspective view of the present invention.

Referring to all drawings provided herein, a gymnastic apparatus 10 of the present invention is shown to comprise the following component parts.

A frame 20 of an inverted Y-shaped construction is composed of a main brace 22 and a support brace 23. Located respectively at each of the two lateral sides of the bottom portion of the main brace 22 is a longitudinally oriented elongate slot 221 of a predetermined length. Both main brace 22 and the support brace 23 are mounted securely on a bottom brace 24 of an I-shaped construction.

Figure 3:
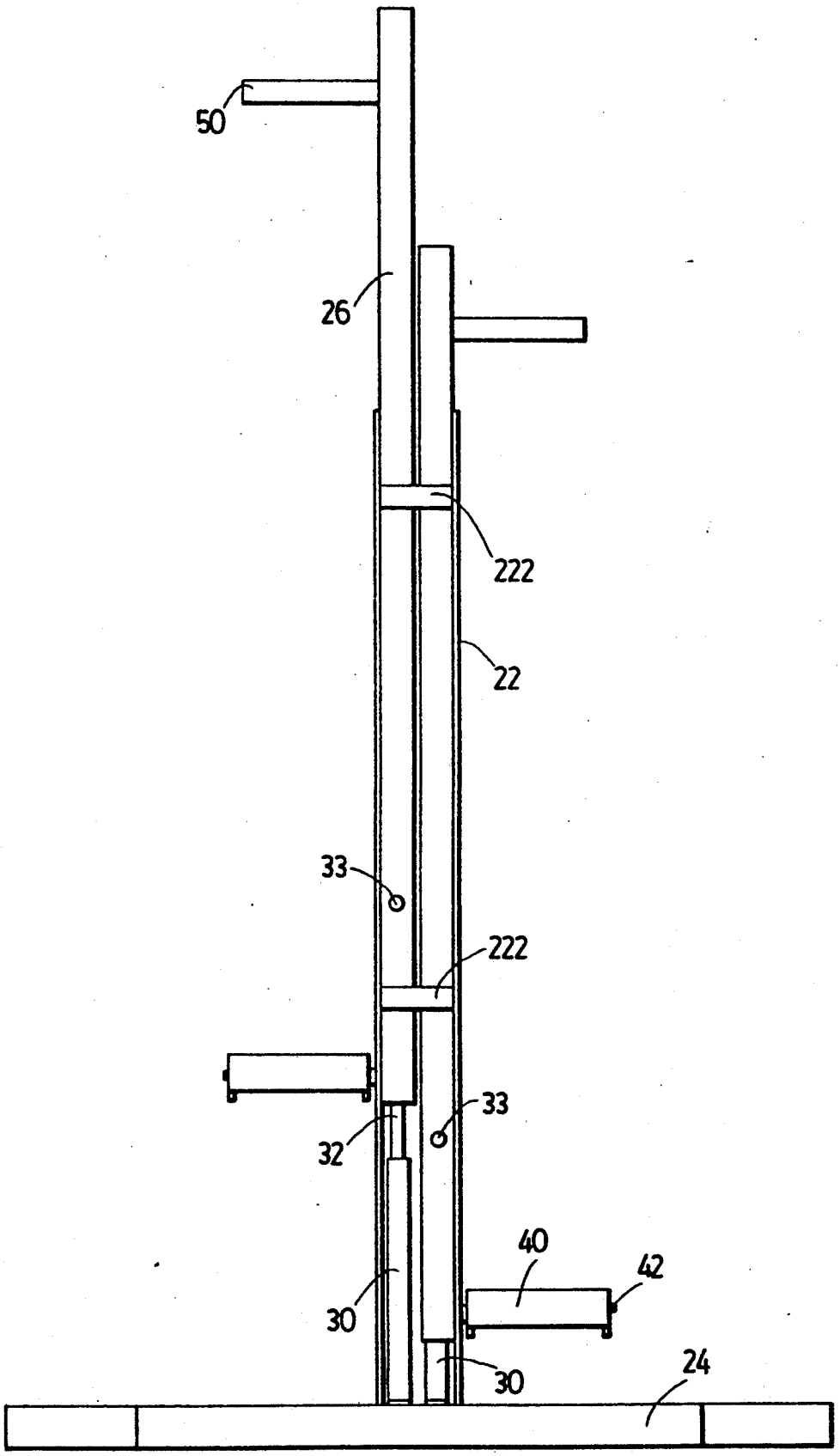
FIG. 3 shows a rear elevational view of the main brace of the present invention.

The two hollow sliding rods 26 are arranged slidably in a parallel manner inside the main brace 22; they can be moved upwards and downwards along the axial direction of the main brace 22. The top end portions of the sliding rods 26 extend beyond the upper end of the main brace 22 for a predetermined length. The main brace 22 is provided in the rear side surface thereof with cylindrical rolling elements 222, as shown in FIG. 3, for facilitating the sliding motion of the two sliding rods 26, with a minimum of mechanical friction.

The two oil pressure cylinders 30 are mounted inside the main brace 22 in a parallel manner and are fastened securely to the bottom of the main brace 22, with their piston rods 32 facing upwards. Each of the two oil pressure cylinders 30 may be mounted inside the sliding rods 26, with the free ends of their piston rods 32 fastened securely to the inner walls of the bottoms of the sliding rods 26 by means of bolts 33, as shown in FIG. 3, so as to secure the sliding rods 26 and to trigger the sliding rods 26 to move.

Figure 2:
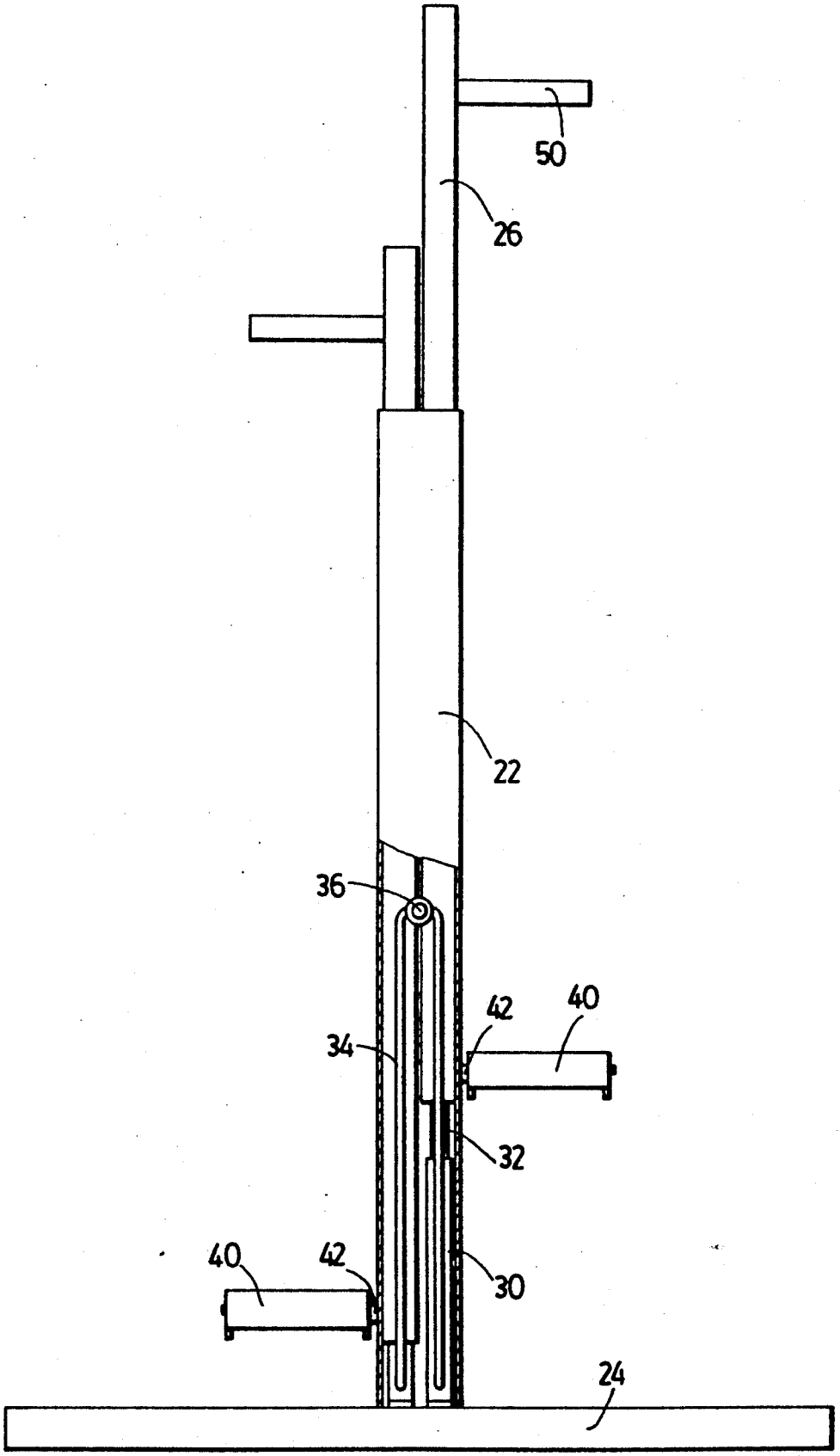
FIG. 2 shows a partial front sectional view of the present invention.

As shown in FIG. 2, the connecting tube 34 has two ends which are connected to the bottom ends of the two oil pressure cylinders 30 so as to facilitate the movement of a fluid between the two cylinders 30.

The adjustment buttom 36 is located at a mid-section of the connecting tube 34 for controlling the passage of the fluid. The button 36 extends out of a round hole 223 of the main brace 22 to be accessible to a user's hand.

Each of the two pedals 40 is provided with a shaft pin 42, which is horizontally fastened to the bottom portion of the sliding rod 26 via the elongate slot 221 of the main brace 22, so as to activate the sliding rod 26 which in turn drives the piston rod 32.

Each of the two hand grips 50 is fastened to the top end of the sliding rod 26 in order to move along with the sliding rod 26.

In operation, the user steps on the pedals 40, with his or her hands holding securely the hand grips 50. As the right pedal 40 is stepped downwards to activate the right sliding rod 26 to move likewise, the piston rod 32 of the right oil pressure cylinder 30 is forced to move downwards, thereby bringing about the movement of the fluid of the right oil pressure cylinder 30 into the left oil pressure cylinder 30 via the connecting tube 34. As a result, the fluid pressure forces the left piston rod 32 to move upwards so as to trigger the upward movement of the left sliding rod 26. Such alternating movements of the two sliding rods 26 brings about an animation of cliff climbing.

The features of the present invention are summarized hereinafter.

The gymnastic apparatus of the present invention is structurally simple and provided with an aesthetic effect. In addition, it is composed of fewer component parts and can be therefore made quickly and economically.

The damping mechanism of the gymnastic apparatus can be easily controlled and adjusted by means of an adjustment button, which is easily accessible to a hand of a user even at such time when the user is in the midst of doing the exercise.

What is claimed is:

1. A gymnastic apparatus providing animation of cliff climbing comprising:

(a) a frame of an inverted Y-shaped construction comprising a bottom brace upon which a hollow main brace and a support brace are mounted;

(b) two hollow sliding rods arranged slidably along the direction of an axis of said main brace;

(c) two oil pressure cylinders arranged in said main brace, with each of said cylinders provided with a piston rod capable of moving synchronously with one of said sliding rods;

(d) a connecting tube communicating said two cylinders so as to facilitate an alternating movement of said two sliding rods in opposite directions;

(e) an adjustment button fastened to a mid-section of said connecting tube;

(f) two pedals fastened respectively to said two sliding rods; and (g) two hand grips fastened respectively to said two sliding rods;

wherein said gymnastic apparatus is characterized in that said main brace is provided with two elongate slots of a length located respectively in two bottom side surfaces of said main brace, and that said main brace of said gymnastic apparatus contains therein said sliding rods, said oil pressure cylinders and said connecting tube, and further that said two sliding rods are parallel to each other and are provided respectively with a top end of a length extending out of said main brace, and still further that said two oil pressure cylinders are fastened to a bottom of said main brace in a parallel manner so that said piston rod of said each of said cylinders is coupled with a bottom of one of said sliding rods so as to permit said each of said cylinders to be received in said one of said sliding rods at such time when said sliding rod moves upwards or downwards, and still further that said adjustment button extends out of said main brace, and finally further that said two pedals are fastened respectively to bottoms of said sliding rods via said two elongate slots of said main brace.

2. The gymnastic apparatus of claim 1 further comprising a predetermined number of cylindrical rolling elements, each of which is pivoted horizontally to said main brace.

* * * * *